United States Patent [19]

Mieger

[11] 4,270,286

[45] Jun. 2, 1981

[54] TOOL SUSPENSION WITH SUPPLY MEANS FOR HYDRAULIC MEDIUM

[75] Inventor: Rolf Mieger, Kirchdorf-Iller, Fed. Rep. of Germany

[73] Assignee: Liebherr-Hydraulikbagger GmbH, Kirchdorf, Fed. Rep. of Germany

[21] Appl. No.: 102,968

[22] Filed: Dec. 12, 1979

[30] Foreign Application Priority Data

Dec. 28, 1978 [DE] Fed. Rep. of Germany ..... 2856556

[51] Int. Cl.[3] ..... E03B 3/00

[52] U.S. Cl. ..... 37/103; 212/238; 137/625.25; 414/657; 251/339

[58] Field of Search ..... 37/103, 1 R, 117.5, 37/DIG. 7; 251/318, 339, 349, 231; 212/203, 237–238, 261, 266, 268, 680; 414/685–692, 694, 710, 715, 723–724, 742, 657; 137/615, 625, 625.18, 625.25

[56] References Cited

U.S. PATENT DOCUMENTS

| | | | |
|---|---|---|---|
| 2,927,706 | 3/1960 | Mork | 414/694 |
| 3,088,489 | 5/1963 | Stacey | 137/625.25 X |
| 3,997,987 | 12/1976 | Tomlinson | 37/103 X |
| 4,032,025 | 6/1977 | Ross | 37/103 |

*Primary Examiner*—E. H. Eickholt

*Attorney, Agent, or Firm*—Morgan, Finnegan, Pine, Foley & Lee

[57] ABSTRACT

A suspension for a replaceable hydraulically operable tool attachment on the tool holder excavator or crane comprises a fork member pivoted to the tool holder by pivot pins which contain bores to establish hydraulic communication between fluid supply and discharge passages in the tool holder and associated passages in the fork member leading to the tool.

2 Claims, 3 Drawing Figures

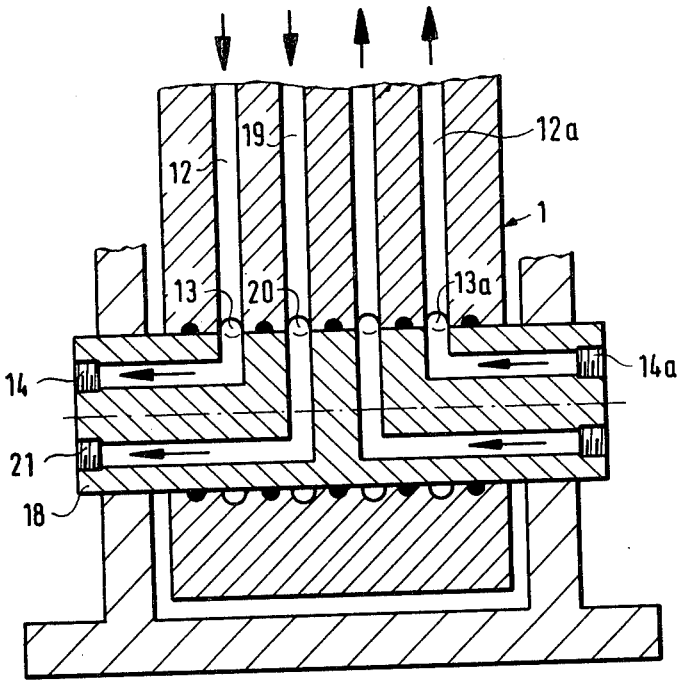
Fig. 2 (B-C)
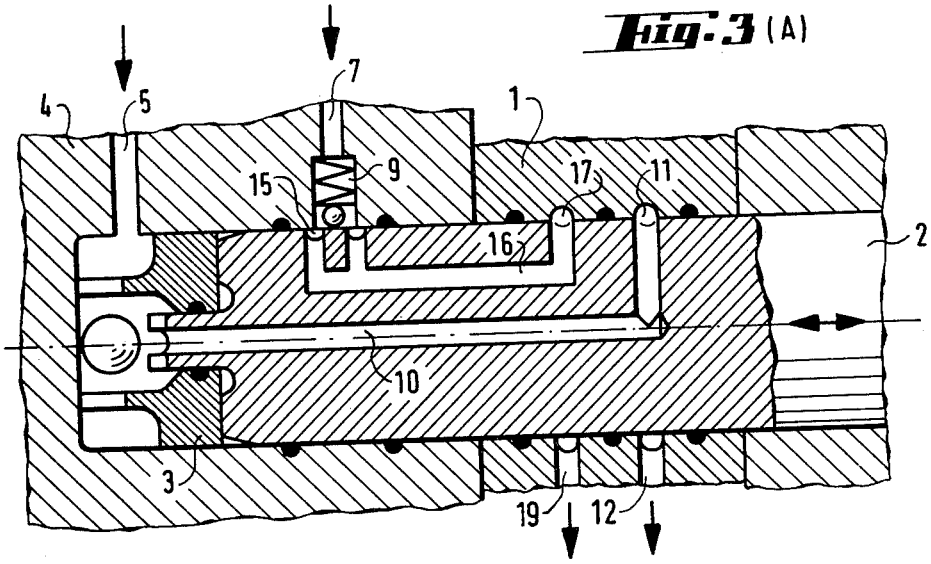
Fig. 3 (A)

TOOL SUSPENSION WITH SUPPLY MEANS FOR HYDRAULIC MEDIUM

The invention relates to a tool suspension for hydraulically operable replaceable tools on a tool shaft of a hydraulic excavator or crane, said suspension comprising a supply of hydraulic medium, wherein coupling is effected by introducing a pivotable fork member in a connecting member of the tool shaft and the pivotable connection of the fork is by means of pins.

Grabs which are suspended from the tool shaft of an excavator by means of a fork or bifurcated member to permit pendulating movement are known from German Specifications Nos. 23 38 736 and 23 43 558. The supply of hydraulic medium is effected by means of hydraulic hoses. In practice, it has been found that the hose connections form kinks when pivoted through extreme angles and may break off and the hoses can also be damaged by external influences.

A further disadvantage resides in the fact that the hydraulic hoses have to be manually coupled.

It is an object of the present invention to provide a tool suspension of the aforementioned kind which enables coupling of the hydraulic medium supply to be effected simultaneously with coupling of the tool without requiring additional manipulation.

According to the invention, this object is achieved by the features recited in the characterising portion of claim 1.

The advantages that can be achieved by means of the invention are that it is possible to establish communication with the supply of hydraulic medium simultaneously with coupling of the tool. Further, the use of hose connections is avoided.

An advantageous embodiment of the invention is characterised in claim 2.

The invention will now be described in more detail with reference to the examples illustrated in the drawing, wherein:

FIG. 2 is a sectional detail taken on the line BC in FIG. 1, and

FIG. 3 is a diagrammatic view of a multi-passage supply being a detail of the portion encircled at A in FIG. 1.

Figure 1:
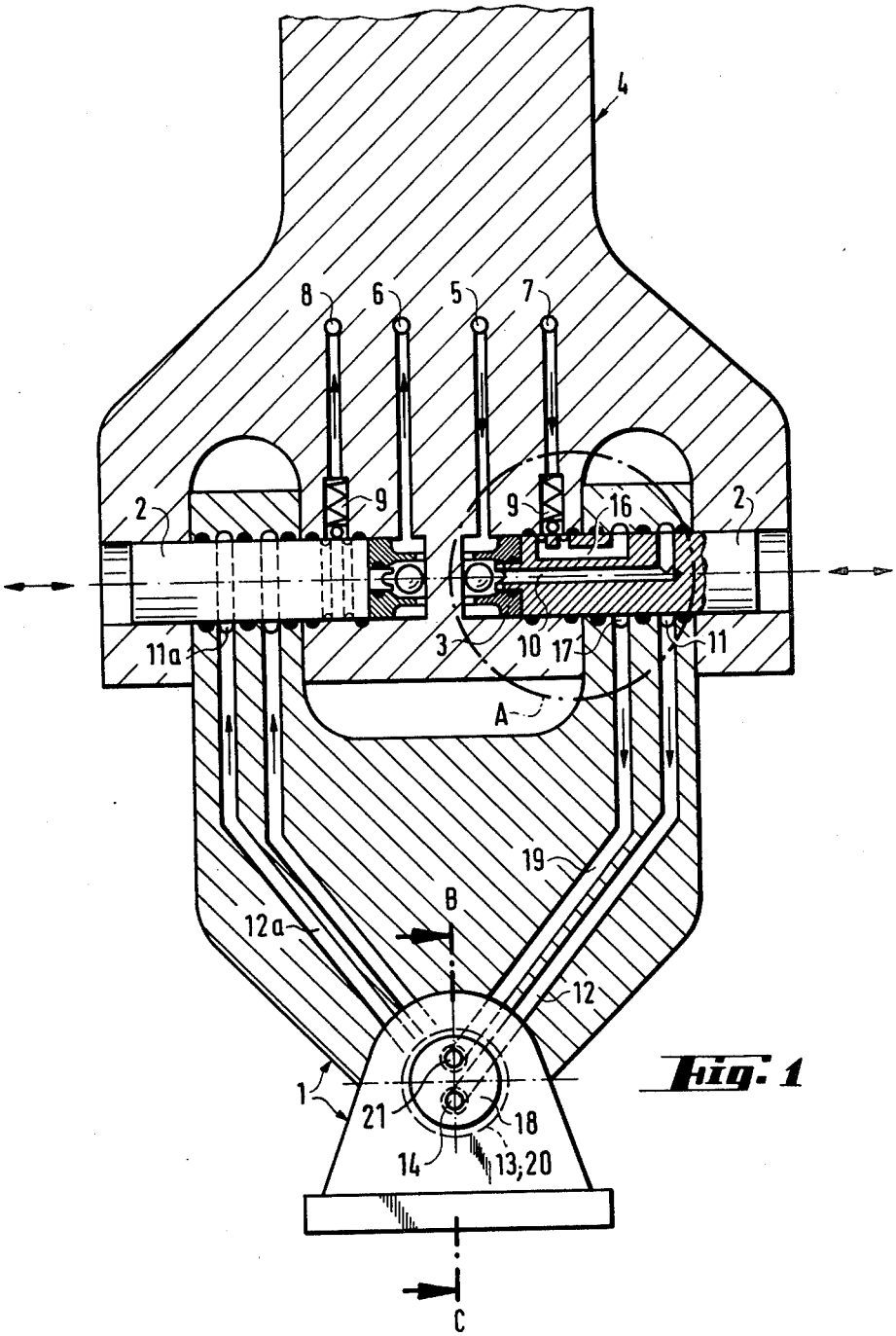
FIG. 1 is a diagrammatic representation of a tool suspension.

After introducing a fork 1 having a tool flanged thereto into a connecting member 4 of a tool shaft, pins 2 are axially displaced towards the centre by means of cylinders (not shown), a valve 3 being opened just before reaching the limiting position. Pressure medium can now flow from a pump through a pressure conduit 5, the valve 3, a bore 10 in the pin 2, an annular passage

11, a bore 12 in the fork 1 and an annular passage 13 to an orifice 14 of the bore 12 in a pin 18 of the fork, whereafter it is transmitted to the tool.

The outflowing pressure medium flows through an orifice 14*a*, an annular passage 13*a*, a bore 12*a*, an annular passage 11*a* and a bore in the other pin 2 to a conduit 6 by way of a valve, and from there into the collecting tank.

The tool suspension permits a multi-passage supply. For this purpose the pins 2 contain an additional axial bore 16 adjacent the axial bore 10. The hydraulic medium flows through a pressure conduit 7 by way of a valve 9, annular passages 15 on the pin 2 and the bore 16 into an annular passage 17 and then by way of a further bore 19 of the fork 1 and a further annular passage 20 on the pin 18 through a further bore through an orifice 21 to the tool. The return flow of the pressure medium is correspondingly constructed, as will be evident from FIGS. 1 and 2.

I claim:

1. A tool suspension for hydraulically operable replaceable tools on a tool shaft of a hydraulic excavator or crane, said suspension comprising a supply of hydraulic medium, wherein coupling is effected by introducing a pivotable fork member in a connecting member of the tool shaft and the pivotable connection of the fork is by means of pins, characterised in that the pressure medium can be fed to the tool through a supply comprising a pressure conduit (5) in the connecting member (4) of the tool shaft, a valve (3) operable in response to displacement of the pin (2) of the connecting member, a longitudinal bore (10) in the pin (2) communicating with an annular passage (11) in the aperture of the fork (1) receiving the pin (2) of the connecting member (4), a bore (12) in the fork (1), an annular passage (13) in the aperture for the pin (18) for pivotably attaching the tool, and a bore with orifice (14) in the pin (18) of the tool, and can be discharged to a collecting tank through an outlet comprising an orifice (14*a*) in the pin (18) of the tool, appropriate bores and annular passages, and a conduit (6).

2. The tool suspension of claim 1, characterised by at least one further supply comprising a pressure conduit (7) with a valve (9) in the connecting member (4), an annular passage (15) and bore (16) in the pin (2) of the connecting member (4), an annular passage (17) in the aperture of the fork (1) receiving the pin (2) of the connecting member (4), a bore (19) in the fork (1), an annular passage (2) in the aperture of the fork (1) receiving the pin (18) of the tool, and a bore with orifice (21) in the pin (18) of the tool, and by at least one further outlet corresponding to said further supply.

* * * * *